US005799853A

United States Patent [19]

Brewster

[11] Patent Number: 5,799,853

[45] Date of Patent: Sep. 1, 1998

[54] CADDY FOR CARRYING GOLFING ITEMS

[76] Inventor: Frederick P. Brewster, 15111 Capetown La., Huntington Bch., Calif. 92647

[21] Appl. No.: 659,118

[22] Filed: Jun. 4, 1996

[51] Int. Cl.[6] ..... A45F 3/00; A63B 57/00

[52] U.S. Cl. ..... 224/679; 224/666; 224/670; 224/683; 224/245; 224/249; 224/918; 224/932

[58] Field of Search ..... 224/245, 918, 224/666, 678, 679, 932, 249, 670, 683; 206/315.1, 315.5; D21/234; D3/221, 254, 259; 473/387

[56] References Cited

U.S. PATENT DOCUMENTS

| | | | |
|---|---|---|---|
| D. 349,550 | 8/1994 | Reeves . | |
| 3,298,579 | 1/1967 | Smith | 224/918 |
| 3,799,331 | 3/1974 | White | 224/249 |
| 4,106,678 | 8/1978 | Thomas . | |
| 4,151,937 | 5/1979 | Jarosh et al. . | |
| 4,475,676 | 10/1984 | Smith . | |
| 4,645,105 | 2/1987 | Plumbridge | 224/918 |
| 4,730,728 | 3/1988 | Larkin . | |
| 4,736,877 | 4/1988 | Clark . | |
| 4,784,305 | 11/1988 | Schoenberg . | |
| 4,850,483 | 7/1989 | Stack . | |
| 4,893,739 | 1/1990 | Conner . | |
| 4,957,232 | 9/1990 | Sprague | 224/932 |
| 4,960,239 | 10/1990 | Wait . | |
| 5,050,830 | 9/1991 | Hall . | |
| 5,143,371 | 9/1992 | Strahan . | |
| 5,158,179 | 10/1992 | Gosselin . | |
| 5,269,410 | 12/1993 | Abregano . | |
| 5,361,958 | 11/1994 | Fiegel et al. | 224/678 |
| 5,372,362 | 12/1994 | Barker . | |
| 5,388,824 | 2/1995 | Reimers . | |
| 5,423,530 | 6/1995 | Alvarez Gonzalez . | |
| 5,433,436 | 7/1995 | Hoyt et al. . | |
| 5,586,674 | 12/1996 | Nachbauer | 224/918 |

FOREIGN PATENT DOCUMENTS

| | | | |
|---|---|---|---|
| 279324 | 11/1951 | Switzerland | 224/245 |

*Primary Examiner*—Linda J. Sholl
*Attorney, Agent, or Firm*—James G. O'Neill

[57] ABSTRACT

A caddy for holding items used by a golfer includes a top surface having a plurality of openings formed therein and connected to internal passages for holding items therein, a front surface having at least one opening therein for holding a ball marker, a rear surface having a rotatable holding clip and an opening adjacent a lower surface thereof for supporting a towel or the like.

12 Claims, 1 Drawing Sheet

CADDY FOR CARRYING GOLFING ITEMS

BACKGROUND OF THE INVENTION

1. Technical Field

This invention relates generally to holding devices, and more particularly, to a carrying device or portable caddy for use by a golfer to easily carry small items in a convenient and accessible manner.

2. Description of Related Art

As any golfer knows, when playing the game of golf, the golfer has need for certain small items, such as a pencil to keep score, golf tees, ball markers and divot repair tools. Depending on the clothes the golfer may be wearing or the equipment he may be carrying, the golfer may carry such small items in their pockets, or in or around their golf bag and golf clubs. However, because of their size and shape, it is sometimes difficult to locate these items, or they tend to get caught in material or in other items, making them difficult to extract from where they are located.

Many attempts have been made to solve this problem of carrying small items used during the game of golf. One such attempt is set forth in U.S. Pat. No. 4,151,937 to Jarosh et al. ("'937"), which discloses a holding device comprised of a small rectangularly shaped plastic box made from molded mating portions. A first or rear mating portion includes a pair of prongs integrally formed therewith and extending from one end thereof. When secured together the molded mating portions form interior cavities at angles to the ends of the box for carrying a pencil and tees, and a slot in one side for holding a ball marker. The rear portion of the device having the prongs formed integrally therewith also includes an opening covered by a laterally offset clip, which clip may be mounted on a belt of a golfer, thus holding the device in a position to enable a golfer to remove the golfing items from the openings. The openings include an angularly disposed opening going from one corner to another corner of the device for holding a pencil which is engaged by tapering walls (or spaced pins) at an inner end thereof, to hold the pencil by a frictional fit. The device also includes openings on one end of the device to frictionally hold golf tees inserted therein. Finally, one side of the device includes a longitudinal slot with a transverse slot having a neck therein for holding a ball marking device.

However, it has been found that the holding device of the '937 patent has problems including the fact that if a pencil inserted in the opening therein is too short, the pencil may be entirely held within the device and not be easily taken out. It is sometimes inconvenient to insert or reinsert the ball marker back into its slot. And, the entire device must be removed from a belt or the like where it is being carried, so that the integrally formed prongs on one end thereof may be used to reinsert a divot.

There, therefore, still exists a need in the art for a simple to use and easy to carry device for carrying all manner of small golfing items used by a golfer during play. The present invention was specifically designed to overcome this need and is felt to do so in a simple and inexpensive manner.

SUMMARY OF THE INVENTION

Accordingly, it is a general object of the present invention to provide a small, portable caddy for holding items. It is a particular object of the present invention to provide a portable caddy for carrying small golfing items in such a manner that they may be easily removed and returned to specific holding portions in the caddy. It is a still more particular object of the present invention to provide a portable caddy having an internal structure which is resilient so that it conforms to and positively holds a number of small items, needed for the game of golf, in a readily accessible position. It is still another particular object of the present invention to provide a small and easy to use golf item holding device having conforming pockets in one end thereof for holding small items to be used by a golfer and which also includes openings formed in the front thereof to hold ball marking devices. And, it is yet a still further object of the present invention to provide a portable caddy for carrying small golfing items which may be clipped to a belt or an item of clothing of a golfer, and which includes an opening for supporting a towel or other item.

In accordance with one aspect of the present invention, there is provided a holding device having a shaped frame and a rotatable holding means on the rear thereof for insertion over a belt or an article of clothing. The device includes a conformable inner area having a plurality of openings and passages therein for securely holding small golfing items inserted therein, and also includes at least one opening in a front surface thereof for holding a ball marker. A lower portion of the device includes an opening to enable other items to be hung from or secured to the holding device.

BRIEF DESCRIPTION OF THE DRAWINGS

The objects and features of the present invention, which are believed to be novel, are set forth with particularity in the appended claims. The present invention, both as to its organization and manner of operation, together with further objectives and advantages, may be best understood by reference to the following description, taken in connection with the accompanying drawings, in which:

DESCRIPTION OF THE PREFERRED EMBODIMENT

Figure 1:
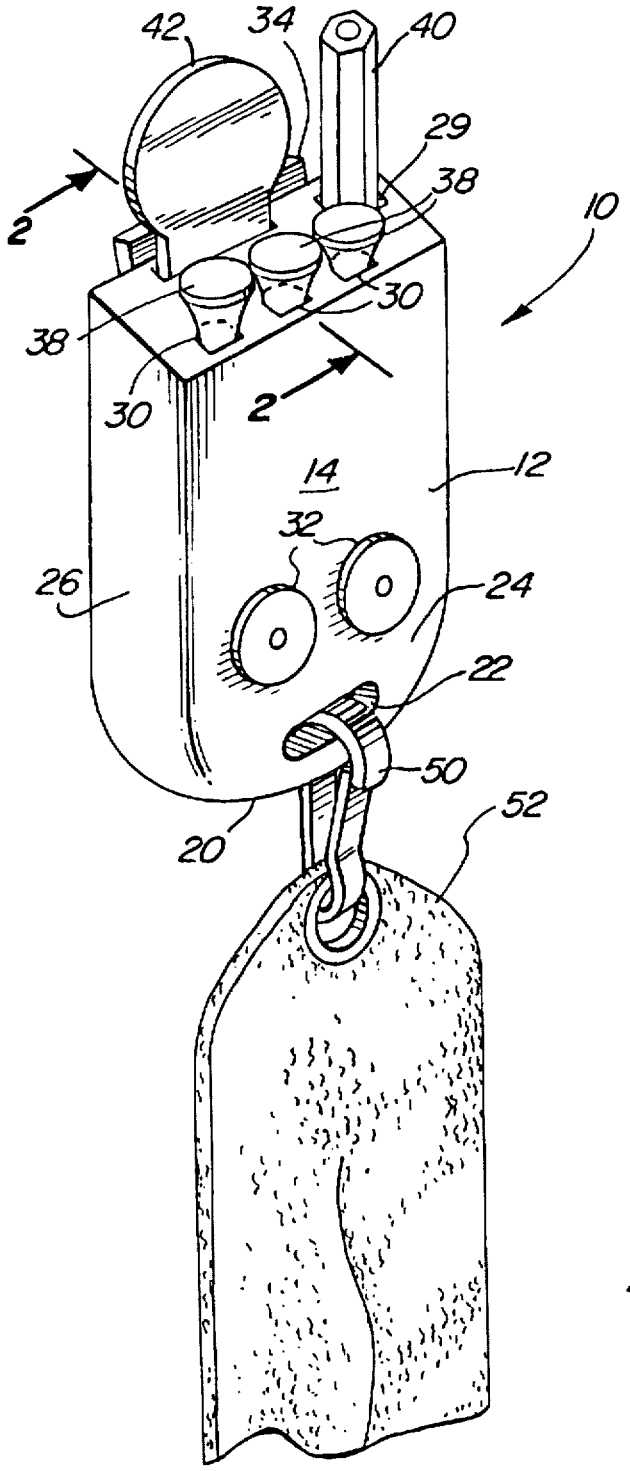
FIG. 1 is a front perspective view of a preferred embodiment of a portable caddy for carrying golfing items of the present invention, and having a lower opening with a towel supported therein.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved portable caddy or holding device, generally identified at 10, for carrying small items used by a golfer.

Turning now to the drawings, the preferred embodiment of the portable caddy 10 of the present invention is shown as having a body 12, which is preferably substantially rectangular in shape, having a front face or surface 14, a rear face or surface 16 and a top face or surface 18, which is preferably formed at an angle. The body 12 also has a bottom face or surface 20, which is preferably rounded as shown in the drawings and which may have an elongated opening 22 formed therein and passing entirely through the body from the front face 14 to the rear face 16. Or, as shown in the drawings, the elongated opening 22 may be formed in a downwardly extending portion 24, which narrow or tapers away from and is formed integrally with or secured to a bottom surface or a lower portion of body 12. The body 12 also has two substantially flat side faces or surfaces 26.

The body 12 may be formed from any desirable material or materials, in any desired manner. In a preferred embodiment of the invention at least the exterior portion of the body 12 is molded from a hard durable plastic, but it is to be understood that the portable caddy 10 may be made from any other material or materials that will be able to be formed into a desired shape as by, forming, molding, machining, or the like, and which may include a separate or integral inner portion which is the same hardness as or more resilient than the outside surface of the body 12.

A top surface 18 of the portable caddy 10 may be formed integrally with the body 12, or may be formed from an insert secured within a hollow cavity formed in the body 12 and having a top surface 18. In either case, the top surface 18 is preferably angled or slanted and includes a plurality of openings 28, 29 and 30 formed therein for inserting golfing items, as is explained more fully below.

The front face 14 of body 12 is provided with at least one and preferably a plurality of small openings, such as two or more circular small openings (not shown) so that a post of one or more ball markers 32 may be inserted in or withdrawn from these small openings for use, in a manner well known to those skilled in the art.

As shown in the drawings, rear surface 16 of the body 12 includes a holding clip 34. This holding clip 34 is preferably rotatably mounted to the rear face 16, as by means of a pin 36 held in openings formed through the holding clip and in shoulders formed to the rear surface 16. The holding clip 34 includes spring biasing means, of a type well known to those skilled in the art, so that it may be rotated between the solid, closed position and the open position, shown in broken line in FIG. 2. The rotatable holding clip 34 allows the device 10, and any items contained therein, as explained more fully below, to be held on a belt or waistband, in a pocket, or in or on any other item of clothing or surface adapted to hold and support the same.

It is to be understood that the portable caddy 10 should be sized and dimensioned so as to easily be stored when not in use, and so that when it is easily worn, as on the belt or around the waistband of pants, shorts or the like, of a golfer.

Figure 2:
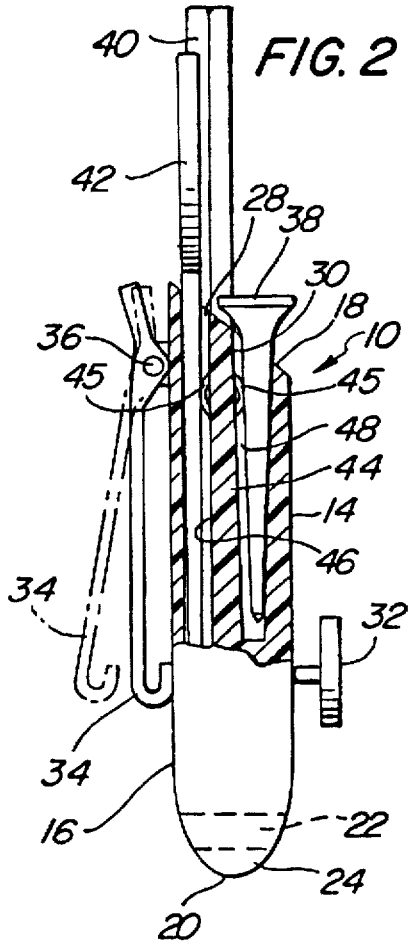
FIG. 2 is a side elevational view, partially in cross section, of the caddy of FIG. 1.
Figure 3:
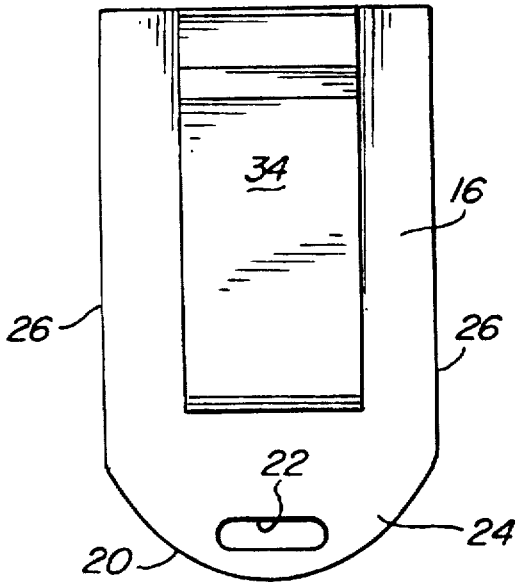
FIG. 3 is a rear elevational view of the portable golf caddy of FIG. 1, without the towel.

As is best shown in FIGS. 1 and 2 of the drawings, the openings 28–30 in the top surface 14 are differently shaped and have a plurality of different shaped items, such as tees 38, a pencil 40, and a divot repair tool 42 inserted and held therein. The various shaped openings 28–30 are preferably formed in an insert or integral interior portion 44, having a plurality of holding means, such as 45, formed therein, and the top angled face 18. As described this insert or internal portion 44 preferably has a plurality of holding means 45 (see FIG. 2) formed in a plurality of passages 46, 48, or the like. These passages 46, 48 may also be formed from resilient material so long as they are substantially the same shape as the items being inserted therein, to positively capture the items in the passages. For example, the opening 28 includes an elongated inner passage 46 which has an inwardly extending holding means 45 which resiliently holds the divot repair tool 42 therein, while the openings 30 include elongated inner passages 48 which have inwardly extending holding means 45 for resiliently holding the tees 38 inserted therein. Likewise, the opening 29 would include a similar passage having holding means (not shown) for resiliently holding the pencil 40 therein. Since the insert or internal portion 44 has passageways and holding means provided therein, or is made from a resilient material, the divot repair tool, pencil and tees held in the passageways will not fall out, even if the portable caddy 10 is dropped or turned upside down.

Turning now to FIG. 1, the opening 22 is shown as having holding means 50, such as a clip, hook or the like secured therein. This holding means is adapted to hold or support a hanging article 52, such as a towel or the like suspended from the portable caddy 10. For example, when the portable caddy 10 is clipped on a belt, or the like, of a user, the towel 52 will hang down from the waist of a user for easy access and use.

Except for specific areas of the front face 14, such as where the ball markers cover the same after being inserted in openings, and the opening 22 formed therein, the front face is substantially unencumbered, and may be used to adhere advertising, decals, logos, etc., on the portable caddy 10.

It, therefore, can be seen that there has been provided herein a novel portable caddy for holding golfing items in a readily available manner, which portable caddy is adapted to hold and receive a plurality of items inserted through a top surface thereof, into passages formed in an interior formed from a resilient material so as to grip and hold the items in place, so that they may be easily removed, used, and reinserted, as desired.

Those skilled in the art will appreciate that the above described preferred embodiments are subject to numerous modifications and adaptations without departing from the scope and spirit of the invention. Therefore, it is to be understood that, within the scope of the appended claims, the invention may be practiced other than as specifically described herein.

What is claimed is:

1. A portable caddy for holding a plurality of items used by a golfer comprising, in combination;

an elongated, substantially rectangular body;

said elongated body, having an elongated front surface with a lower portion and an upper portion;

a pair of small openings formed in said lower portion of said elongated front surface for holding a pair of ball markers;

said upper portion of said elongated front surface being unencumbered to enable decorative material to be adhered thereto;

a pair of elongated side surfaces;

an elongated rear surface having a rotatable holding clip mounted thereon;

a top surface having a plurality of shape openings formed therein connected to resilient internal passageways formed between said elongated front surface, said pair of elongated side surfaces and said elongated rear surface, for holding a plurality of different shaped golfing items inserted in said plurality of shaped openings;

an elongated opening formed in said lower portion of said elongated front surface, below said pair of small openings adjacent a lower surface of said elongated body; and a holding means secured in said elongated opening for supporting a further item.

2. The portable caddy of claim 1 wherein said plurality of different shaped golfing items held in said plurality of shaped openings in said portable caddy are a divot repair tool, a pencil, and a plurality of tees.

3. The portable caddy of claim 2 wherein there are a plurality of small openings formed in said front surface for holding a plurality of ball markers.

4. The portable caddy of claim 3 wherein said elongated opening in said front surface includes a clip for holding and supporting a towel.

5. The portable caddy of claim 1 wherein said elongated opening in said front surface includes a holding means for holding and supporting said further item.

6. The portable caddy of claim 5 wherein said further item is a towel and said plurality of different shaped golfing items held in said plurality of shaped openings in said portable caddy are a divot repair tool, a pencil, and a plurality of tees.

7. The portable caddy of claim 6 wherein there are a plurality of small, circular openings formed in said front surface for holding a plurality of ball markers by a post formed on said ball markers.

8. The portable caddy of claim 1, wherein there are a plurality of openings in said front surface for holding a plurality of ball markers.

9. The portable caddy of claim 8 wherein said elongated opening in said front surface includes a clip means for holding and supporting a towel.

10. The portable caddy of claim 9 wherein said plurality of different shaped golfing items held in said plurality of shaped openings in said portable caddy are a narrow and elongated divot repair tool, a pencil, and a plurality of tees.

11. A portable caddy having an elongated body for holding a plurality of different shaped golfing items used by a golfer comprising, in combination:

a substantially flat, elongated front surface having a lower portion and an upper portion, with a plurality of small openings formed in said lower portion for holding a plurality of ball markers; said upper portion being unencumbered to enable decorative material to be secured thereto;

a substantially flat, elongated rear surface having a holding clip rotatably mounted on shoulder means formed on said elongated rear surface for movement between a closed position against said elongated rear surface and an open position, away from said elongated rear surface;

a pair of side surfaces;

a slanted top surface having a plurality of different shaped openings formed therein connected to similarly shaped internal passageways, formed between said elongated front surface, said pair of side surfaces, and said elongated rear surface, each of said internal passageways having integral resilient means formed therein for holding said plurality of different shaped golfing items therein; and an elongated opening formed in said lower portion of said substantially flat, elongated front surface adjacent a lower surface of said elongated body, and a supporting means held in said elongated opening.

12. The portable caddy of claim 11 wherein said plurality of different shaped golfing items held in said plurality of different shaped openings formed in said slanted top surface are a divot repair tool, a pencil, and a plurality of tees; and wherein said supporting means held in said elongated opening in said front surface is a clip for holding and supporting a towel.

* * * * *